US008781365B2

(12) United States Patent
Inoue

(10) Patent No.: US 8,781,365 B2
(45) Date of Patent: Jul. 15, 2014

(54) AUTOMATIC DOCUMENT TRANSPORTATION DEVICE AND DOCUMENT SCANNING DEVICE

(75) Inventor: Hirokazu Inoue, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 117 days.

(21) Appl. No.: 12/955,947

(22) Filed: Nov. 30, 2010

(65) Prior Publication Data

US 2011/0148034 A1 Jun. 23, 2011

(30) Foreign Application Priority Data

Dec. 17, 2009 (JP) ..... 2009-286372

(51) Int. Cl.
*B65H 5/06* (2006.01)

(52) U.S. Cl.
USPC ..... 399/124; 399/125; 271/264

(58) Field of Classification Search
USPC ..... 399/110, 124, 125; 271/264
See application file for complete search history.

(56) References Cited

U.S. PATENT DOCUMENTS

| | | | | |
|---|---|---|---|---|
| 4,293,214 | A * | 10/1981 | George et al. | 399/403 |
| 4,507,667 | A | 3/1985 | Tsuboi | |
| 4,562,444 | A | 12/1985 | Nagashima et al. | |
| 4,705,384 | A * | 11/1987 | Mizutani et al. | 399/108 |
| 4,754,337 | A * | 6/1988 | Nohtomi et al. | 358/401 |
| 4,789,876 | A * | 12/1988 | Miyai et al. | 399/108 |
| 5,331,374 | A * | 7/1994 | Abe et al. | 399/124 |
| 5,491,567 | A | 2/1996 | Morikawa et al. | |
| 5,504,587 | A * | 4/1996 | Morikawa et al. | 358/400 |
| 5,802,426 | A * | 9/1998 | Miyazaki et al. | 399/113 |
| 6,829,453 | B2 * | 12/2004 | Kouzu | 399/124 |
| 6,851,802 | B2 * | 2/2005 | Sakakibara et al. | 347/108 |
| 6,950,619 | B2 * | 9/2005 | Sunohara | 399/124 |
| 7,019,870 | B2 * | 3/2006 | Kameyama et al. | 358/474 |
| 7,734,218 | B2 * | 6/2010 | Oohata et al. | 399/122 |
| 8,419,006 | B2 * | 4/2013 | Imura | 271/3.14 |
| 2008/0175620 | A1 | 7/2008 | Ohta et al. | |
| 2009/0122330 | A1 | 5/2009 | Andoh et al. | |
| 2010/0158560 | A1 * | 6/2010 | Watanabe | 399/110 |

FOREIGN PATENT DOCUMENTS

| | | | |
|---|---|---|---|
| DE | 33 17 060 | A1 | 11/1983 |
| GB | 2 240 584 | A | 8/1991 |
| JP | 2005-018011 | A | 1/2005 |

(Continued)

OTHER PUBLICATIONS

Official Communication issued in corresponding European Patent Application No. 10194996.4, mailed on Aug. 19, 2011.

*Primary Examiner* — Ernesto Suarez
(74) *Attorney, Agent, or Firm* — Keating & Bennett, LLP

(57) ABSTRACT

An automatic document transportation device includes an ADF main body, a first lock pin and a second lock pin, a cover, a first lock lever and a second lock lever, and an unlock portion. The first lock pin and the second lock pin are arranged in the ADF main body. The cover is supported in an openable/closable manner at the ADF main body. The first lock lever and the second lock lever lock the cover so as not to open by being hooked at the first lock pin and the second lock pin when the cover is closed. The unlock portion is arranged on the surface on the ADF main body side of the cover and in the vicinity of the end of the distal end side of the cover, and can unlock the lock of the first lock lever and the second lock lever.

6 Claims, 6 Drawing Sheets

(56) References Cited

FOREIGN PATENT DOCUMENTS

| | | | |
|---|---|---|---|
| JP | 2006-039170 | A | 2/2006 |
| JP | 2008-011541 | A | 1/2008 |
| JP | 2009-037186 | A | 2/2009 |
| JP | 2009-086628 | A | 4/2009 |
| JP | 2009-161281 | A | 7/2009 |

* cited by examiner

AUTOMATIC DOCUMENT TRANSPORTATION DEVICE AND DOCUMENT SCANNING DEVICE

CROSS-REFERENCE TO RELATED APPLICATIONS

This application claims priority under 35 U.S.C. 119 to Japanese Patent Application NO. 2009-286372, filed on Dec. 17, 2009, which application is hereby incorporated by reference in its entirety.

BACKGROUND OF THE INVENTION

1. Field of the Invention

The present invention relates to an automatic document transportation device and a document scanning device for scanning the document while transporting the document with the automatic document transportation device.

2. Description of the Related Art

Conventionally, a configuration including a cover that enables an interior to be opened has been adopted to facilitate various maintenance tasks such as removing jammed documents in the automatic document transportation device (auto document feeder, ADF), an image forming device, and the like.

In a device equipped with such a cover, a configuration with a lock function is known to prevent the cover from opening carelessly or undesirably when the cover is closed. The known art includes an image forming device with this type of cover.

The known image forming device includes an upper cover member for covering an upper surface of an image forming device main body. The upper cover member includes a supporting shaft and a lock claw attached to the supporting shaft at the end. The upper cover member is locked so as not to open by having the lock claw engage an engagement portion of the device main body. An operation lever is arranged at the upper surface of the upper cover member and on the same supporting shaft as the lock claw. When the operation lever is turned, the lock claw turns thereby disengaging the engagement portion of the device main body and the lock claw, and unlocking the upper cover member.

Another known image forming device includes a jam access cover at a side surface of the image forming device main body. The jam access cover has an uniform hook on an inner side. The hook engages a receiving portion of the device main body to lock the jam access cover so as not to open. An operation knob is formed at a side surface of the jam access cover, so that the hook can separate from the receiving portion by turning the operation knob thereby unlocking the jam access cover.

The operation unit for unlocking the lock of, not only the cover described above, but also the cover of the automatic document transportation device, the image forming device, and the like is usually arranged on an outer side of the cover.

However, if the operation unit is arranged on the outer side of the cover, concave-convex shapes, grooves, and the like form at a surface on the outer side of the cover. The document tends to get caught at such concave-convex shapes, grooves and the like.

Furthermore, the concave-convex shapes, the grooves, and the like tend to affect the outer appearance of the device if such an operation unit is arranged on the outer side of the cover.

SUMMARY OF THE INVENTION

In view of the above, preferred embodiments of the present invention provide an automatic document transportation device in which a cover can be locked to a main body and in which an outer appearance of the cover is simplified.

According to a preferred embodiment of the present invention, an automatic document transportation device includes a main body, a main body side lock portion, a cover, a cover side lock portion, and an unlock portion. The main body side lock portion is arranged in the main body. The cover is supported in an openable/closable manner at the main body. The cover side lock portion locks the cover so as not to open by being hooked to the main body side lock portion when the cover is closed. The unlock portion is arranged on a surface on the main body side of the cover and in the vicinity of an end on a distal end side which is a side distant from a rotation shaft of the cover, and can unlock the cover side lock portion.

In other words, if the unlock portion is exposed to the outer side of the cover, the documents, and the like may get caught at the unlock portion. In this regards, the surface on the outer side of the cover can be flattened since the unlock portion is arranged on the inner side of the cover according to the above configuration, and hence the documents, and the like can be prevented from being caught. Furthermore, the outer appearance of the automatic document transportation device can be simplified.

The above automatic document transportation device preferably has the following configuration. In other words, the automatic document transportation device includes a rotation shaft arranged to connect the unlock portion and the cover side lock portion. The unlock portion includes an operating portion and a connecting portion. The operating portion is arranged on the distal end side relative to the rotation shaft and is to be operated by a user. The connecting portion connects the operating portion and the rotation shaft. The cover side lock portion performs a rotating operation by an operation force applied on the operating portion, and the lock of the cover can be unlocked by the rotating operation.

Therefore, a space between the rotation shaft line of the rotation shaft and the operating portion can be effectively used. Therefore, the cover is miniaturized, and a compact automatic document transportation device can be realized.

In the above automatic document transportation device, a roller associated with paper feeding is preferably arranged between the operating portion and the rotation shaft line of the rotation shaft on the surface on the main body side of the cover.

Therefore, the roller associated with paper feeding such as the pickup roller can be arranged on the distal end side of the cover, whereby the length from the end on the basal end side to the end on the distal end side of the cover can be shortened.

In the above automatic document transportation device, a direction of rotating the unlock portion to unlock the lock is preferably the same as a direction of opening the cover.

Thus, a direction of force applied by the user on the unlock portion to unlock the lock and a direction of force applied by the user on the cover to open the cover may be the same. The user thus can open the cover while unlocking the lock with a simple method.

In the above automatic document transportation device, the unlock portion is preferably positioned at a center in a width direction of a document to be transported.

The cover thus can be smoothly opened since force can be uniformly applied on the cover.

In the above automatic document transportation device, the unlock portion is preferably formed with a guide portion arranged to guide the document to be transported.

The unlock portion is thus prevented from inhibiting the transportation of the document. Furthermore, the number of components can be reduced by forming the guide portion in the unlock portion, so that the cost can be reduced.

In the above automatic document transportation device, a second unlock portion is preferably arranged in addition to the unlock portion.

Thus, the cover can be unlocked from various positions.

Another preferred embodiment of the present invention provides a document scanning device including the automatic document transportation device according to preferred embodiments of the present invention described above.

A document scanning device including an automatic document transportation device with a simple outer appearance thus can be realized.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
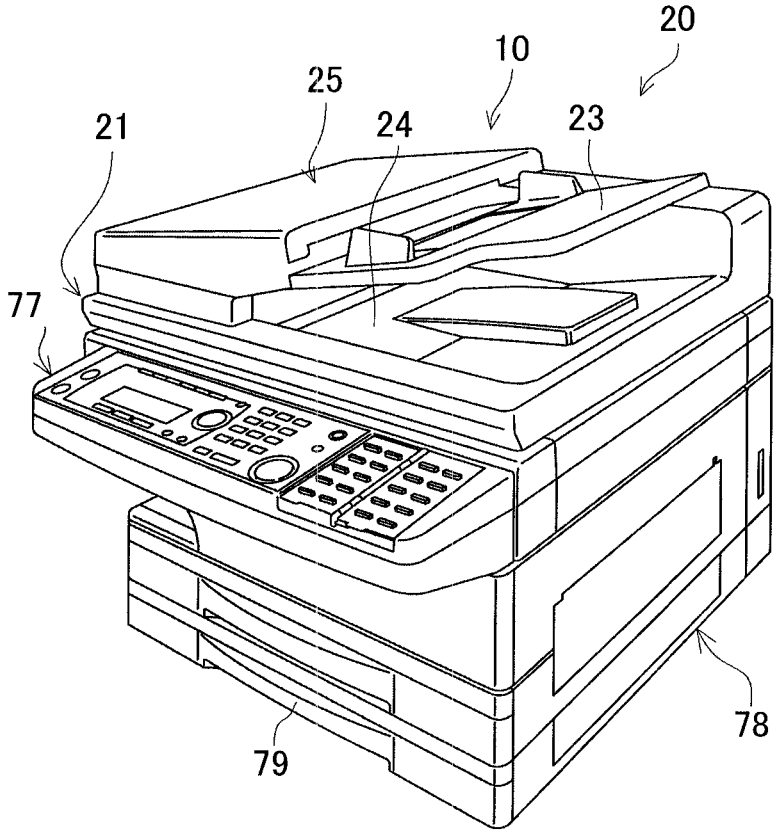
FIG. 1 is a perspective view of an outer appearance of a multifunction peripheral according to one preferred embodiment of the present invention.

Preferred embodiments of the present invention will be described below with reference to the drawings. FIG. 1 is a perspective view of an outer appearance of a multifunction peripheral 20 according to one preferred embodiment of the present invention.

The multifunction peripheral 20 has a copy function and a facsimile function, and includes an image scanner device (document scanning device) 10 that functions as a book scanner and an auto document feed scanner at an upper portion of the multifunction peripheral 20, as illustrated in FIG. 1. The multifunction peripheral 20 also has an operation panel 77 to provide instructions regarding number of copies, facsimile transmitting destination, document scanning, and the like.

The multifunction peripheral 20 further includes a multifunctional peripheral main body 78, which incorporates an image forming unit to form images on a paper serving as a record medium, and a paper feed cassette 79 to sequentially supply the paper. The multifunction peripheral main body 78 includes a transmission and reception unit (not illustrated) to transmit image data through a communication line, and the like.

Figure 2:
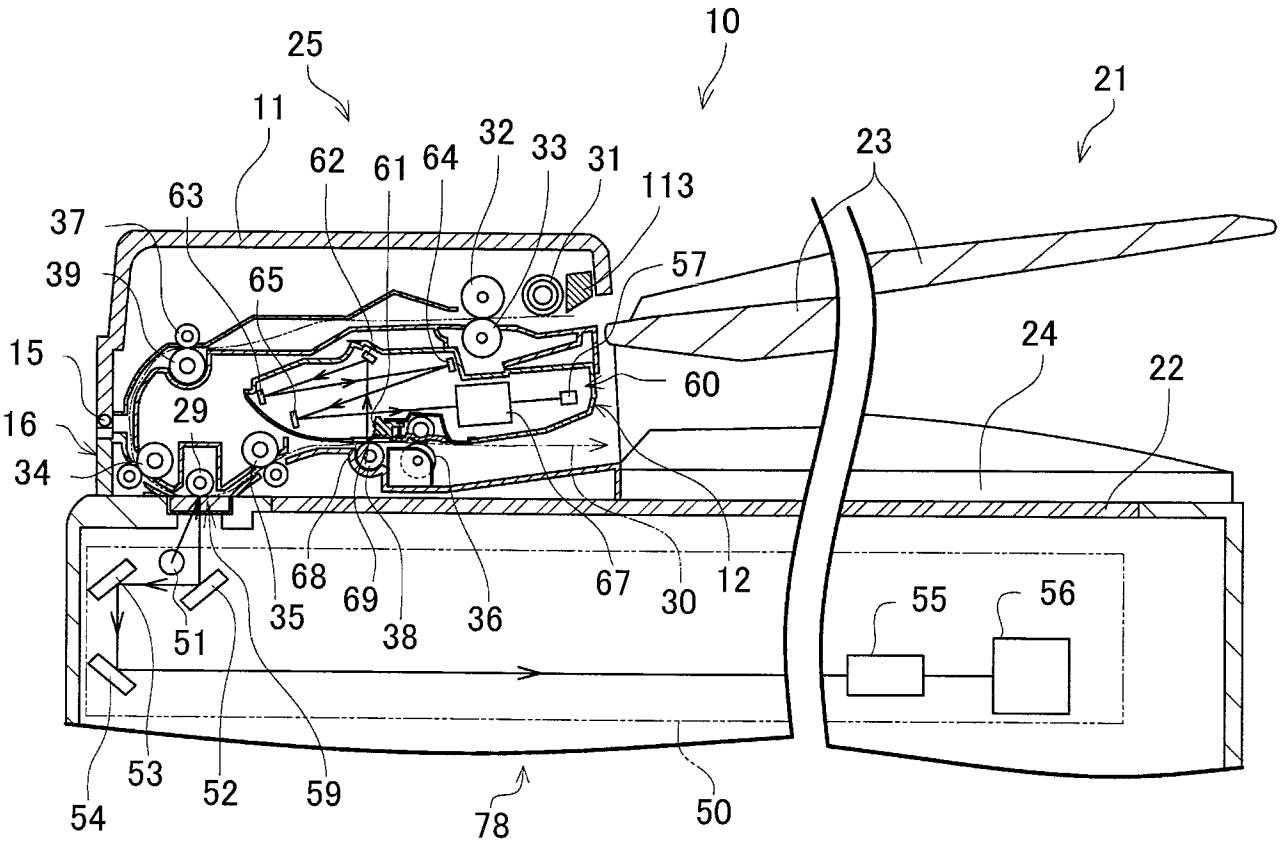
FIG. 2 is a front cross-sectional view of an automatic document transportation device in a case where a cover is closed.
Figure 3:
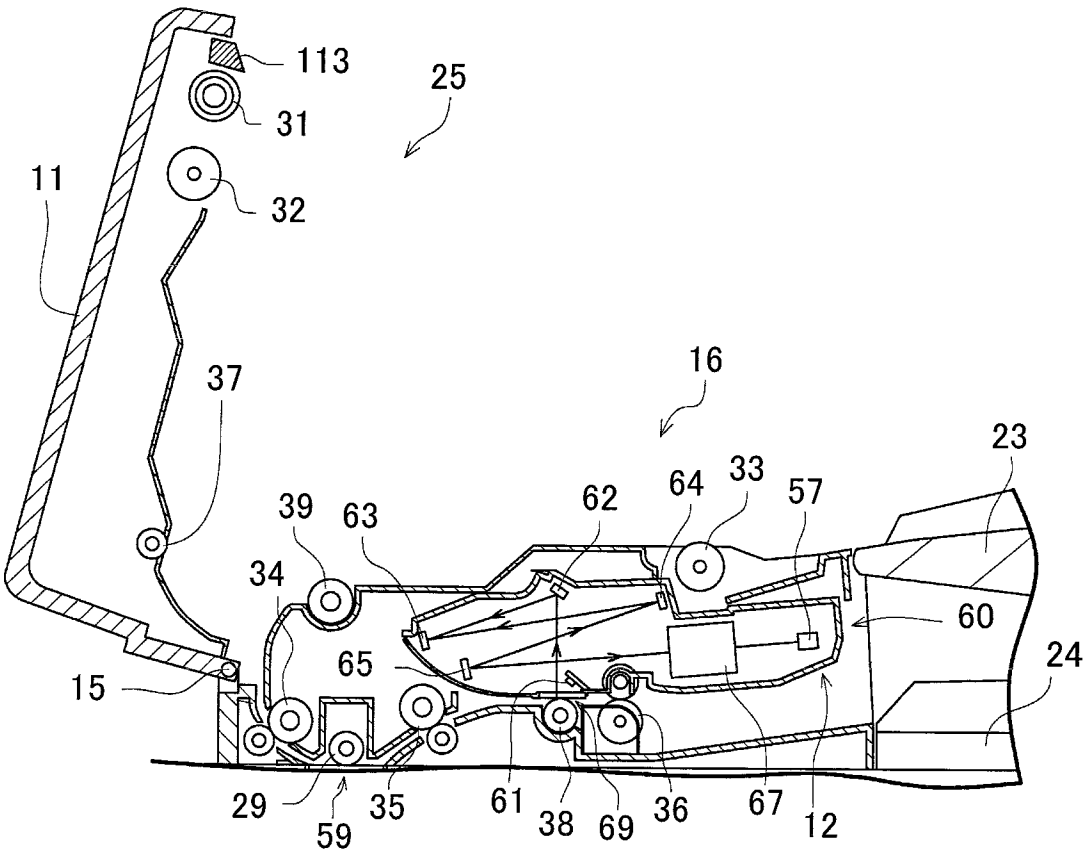
FIG. 3 is a front cross-sectional view of the automatic document transportation device in a case where the cover is opened.

The image scanner device 10 arranged in the multifunction peripheral 20 will now be described with reference to FIGS. 2 and 3. FIG. 2 is a front cross-sectional view of the automatic document transportation device in a case where a cover is closed. FIG. 3 is a front cross-sectional view of the automatic document transportation device in a case where the cover is opened.

As illustrated in FIG. 2, the image scanner device 10 includes a platen glass 22 and a platen cover 21. The platen cover includes the automatic document transportation device (auto document feeder, ADF) 25. The image scanner device 10 also includes a main body side scanner unit 50 and an ADF side scanner unit 60 to scan the image of the document.

When using the image scanner device 10 as the auto document feed scanner, the document is transported one at a time by the ADF 25. The image of the surface on the front side (first surface) of the document is scanned by the main body side scanner unit 50, and the image of the surface on the back side (second surface) is scanned by the ADF side scanner unit 60.

When using the image scanner device 10 as the book scanner, the user places a book or document to be scanned on the platen glass 22, presses the platen cover 21 thereon, and fixes the book document so that it does not move. The image of the document then can be scanned by the main body side scanner unit 50 in such a state.

As illustrated in FIG. 2, the ADF 25 arranged in the platen cover 21 includes a document tray 23 arranged at the upper portion of the platen cover 21, and a discharge tray 24 arranged at a lower side of the document tray 23. The ADF 25 also includes an ADF main body (main body) 16, and a cover 11 arranged to cover an upper side thereof.

As illustrated in FIG. 3, the cover 11 is rotatably supported at an ADF main body 16 through a cover turning shaft 15. The configuration is such that cover 11 can be locked so as not to open carelessly and undesirably when the cover 11 is closed. The details on the cover 11 and the lock function will be described later.

As illustrated in FIG. 2, a curved (laterally facing U-shape in front view) document transportation path 30 to connect the document tray 23 and the discharge tray 24 is configured inside the platen cover 21. With such a configuration, the documents set in a superimposed manner on the document tray 23 are separated one by one and transported along the document transportation path 30 and discharged to the discharge tray 24. An instruction to start scanning the document, and the like can be made by the operation panel 77 illustrated in FIG. 1.

A configuration of each section of the ADF 25 will now be described in detail along the document transportation path 30.

As illustrated in FIG. 2, a pickup roller 31 is arranged in an area where the document is supplied from the document tray 23 to the document transportation path 30. A separation roller 32 is arranged on a downstream side of the pickup roller 31. An opposing roller 33 is arranged so as to face the separation roller 32 when the cover 11 is closed.

With such a configuration, the document on the uppermost layer of the document tray 23 is fed into the ADF 25 when the pickup roller 31 is driven. The document is sent to the separation roller 32 by the drive of the pickup roller 31, and is nipped between the separation roller 32 and the opposing roller 33. The document is then separated one by one by the separation roller 32, which rotatably drives in a document transporting direction, and the opposing roller 33, which rotatably drives in a direction opposite to the document transporting direction, and then transported to a downstream side of the document transportation path 30.

A resist roller 39 and a press roller 37, which defines a pair with the resist roller 39, are arranged on a downstream side of the separation roller 32. The resist roller 39 temporarily stops and loosens a leading side of the document being transported by the separation roller 32 along with the press roller 37, and transports the same to the downstream side while removing the loosening after a predetermined time. Any obliqueness of the document is thereby corrected.

A plurality of transportation rollers 34, 35 are arranged on a downstream side of the resist roller 39. Rollers are also arranged so as to face each transportation roller 34, 35. The document transported to the downstream side by the drive of the resist roller 39 is nipped by the transportation rollers 34, 35 and the rollers facing thereto, and then further transported to the downstream side.

A first document scan position 59 is set between two transportation rollers 34, 35, and a platen roller 29 is arranged at the first document scan position 59. The document that passes the first document scan position 59 is scanned by the main body side scanner unit 50, to be described later, and read.

The main body side scanner unit 50 will now be described. The main body side scanner unit 50 is arranged on the lower side of the ADF 25 and the platen glass 22 (outer side of the document transportation path 30). The main body side scanner unit 50 includes a light source 51, reflecting mirrors 52, 53, 54, a light-gathering lens 55, and a main body side charge coupled device (CCD) 56. The light source 51 irradiates the first document scan position 59 (or platen glass 22) of the ADF 25 with light, and the reflecting mirrors 52, 53, 54 reflect the reflected light from the document. The reflected light is converged by the light-gathering lens 55, and the converged light is imaged at the portion of the main body side CCD 56.

The light source 51, the reflecting mirror 52, and the like of the main body side scanner unit 50 are configured to be movable. When using the image scanner device 10 as the book scanner, as described above, the light source 51, the reflecting mirror 52, and the like of the main body side scanner unit 50 are moved along the platen glass 22. The document placed on the platen glass 22 then can be scanned.

When using the image scanner device 10 as the auto document feed scanner, on the other hand, the light source 51, the reflecting mirror 52, and the like are moved up to the position facing the first document scan position 59 and made still thereat, as illustrated in FIG. 2. When the ADF 25 is driven in such a state, the surface on the front side of the document transported through the document transportation path 30 and passed the first document scan position 59 can be scanned by the main body side scanner unit 50 and read.

In the main body side scanner unit 50, the reflected light from the document is guided to the main body side CCD 56 and imaged, as described above, and the main body side CCD 56 outputs an electric signal corresponding to the image information of the document. The signal is appropriately subjected to the conversion process, and transmitted to the image forming unit of the multifunction peripheral 20. The transmitted image information is transferred onto the paper serving as the record medium by the image forming unit, thereby realizing the copy function, etc. of the multifunction peripheral 20.

In the document transportation path 30, a second document scan position 69 is set on a downstream side (downstream side of the transportation roller 35) of the first document scan position 59. The back surface of the document passing the second document scan position 69 is scanned by the ADF side scanner unit 60, to be described next, and read.

The ADF side scanner unit 60 will be described. The ADF side scanner unit 60 is installed on the inner side of the document transportation path 30 so as to contact the document transportation path 30 formed to a U-shape from the inner side. The ADF side scanner unit 60 includes a scanner frame 12 held at the interior of the ADF 25. The scanner frame 12 is configured to support components configuring the interior optical system, and the like, and also to cover the outer side thereof to protect the same.

A scan glass 68 for scanning the back surface of the document is arranged at the bottom of the scanner frame 12. The scan glass 68 is arranged at a position corresponding to the second document scan position 69.

A platen roller 38 is arranged in the ADF 25 so as to face the second document scan position 69 of the scanner frame 12. With such a configuration, when the document transported by the transportation roller 35 reaches the portion of the platen roller 38, the surface on the back side of the relevant document is scanned and read while being transported by the platen roller 38.

The document in which the contents on both the front and back surfaces are scanned at two document scan positions in the above manner is then transported by the discharge roller 36 and discharged to the discharge tray 24. In this manner, a so-called one-pass type ADF 25 having a configuration in which both surfaces of the document can be scanned by simply passing the document through the document transportation path 30 once is configured.

A reduction optical system configured in the ADF side scanner unit 60 will now be described. As illustrated in FIG. 2, the ADF side scanner unit 60 includes alight source 61, reflecting mirrors 62, 63, 64, 65, a light-gathering lens 67, and an ADF side CCD 57 serving as an image sensor. These components are all arranged inside the scanner frame 12.

The light source 61 is arranged to face the scan glass 68, so that the second document scan position 69 can be irradiated with light through the scan glass 68. The reflecting mirrors 62, 63, 64, 65 are configured to further reflect the reflected light from the document over plural times so as to turn back, and to guide the reflected light towards the light-gathering lens 67.

The light-gathering lens 67 converges the light and images the light at the portion of the ADF side CCD 57, and the ADF side CCD 57 outputs an electric signal corresponding to the image information of the document, similar to the main body side CCD 56 in the main body side scanner unit 50. The signal is also appropriately subjected to the conversion process, and transmitted to the image forming unit of the multifunction peripheral 20.

Figure 4:
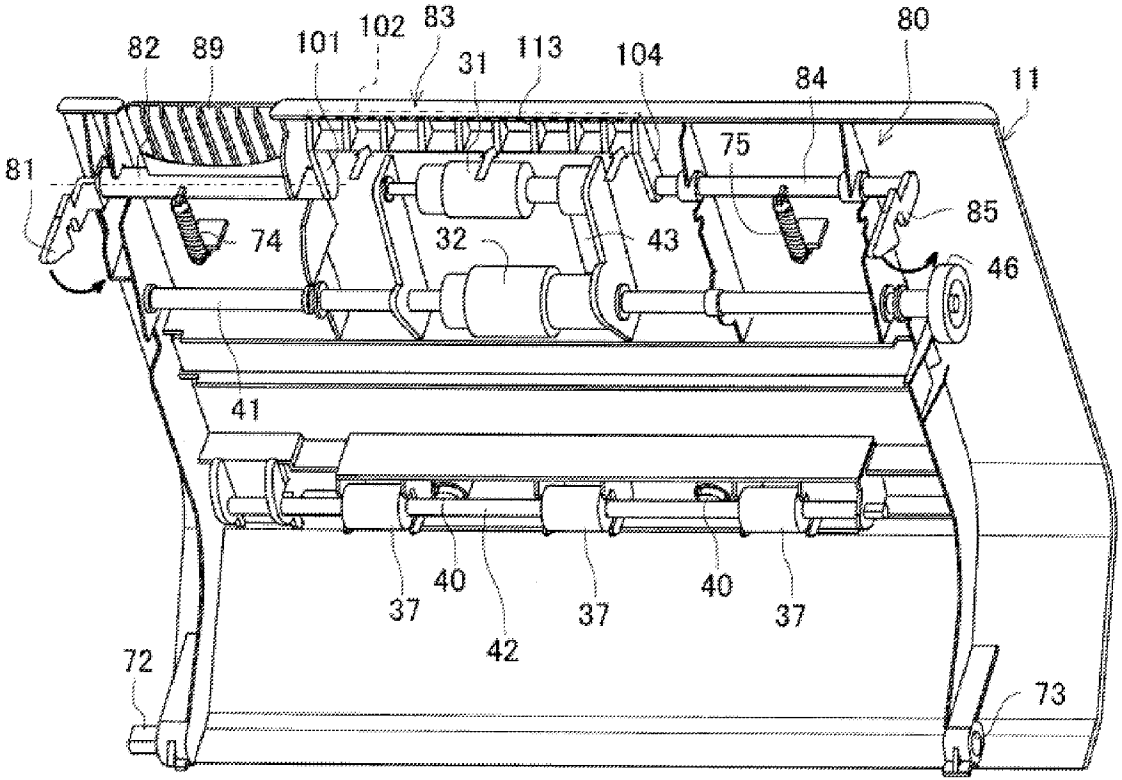
FIG. 4 is a perspective view illustrating a state of the cover on an ADF main body side.
Figure 5:
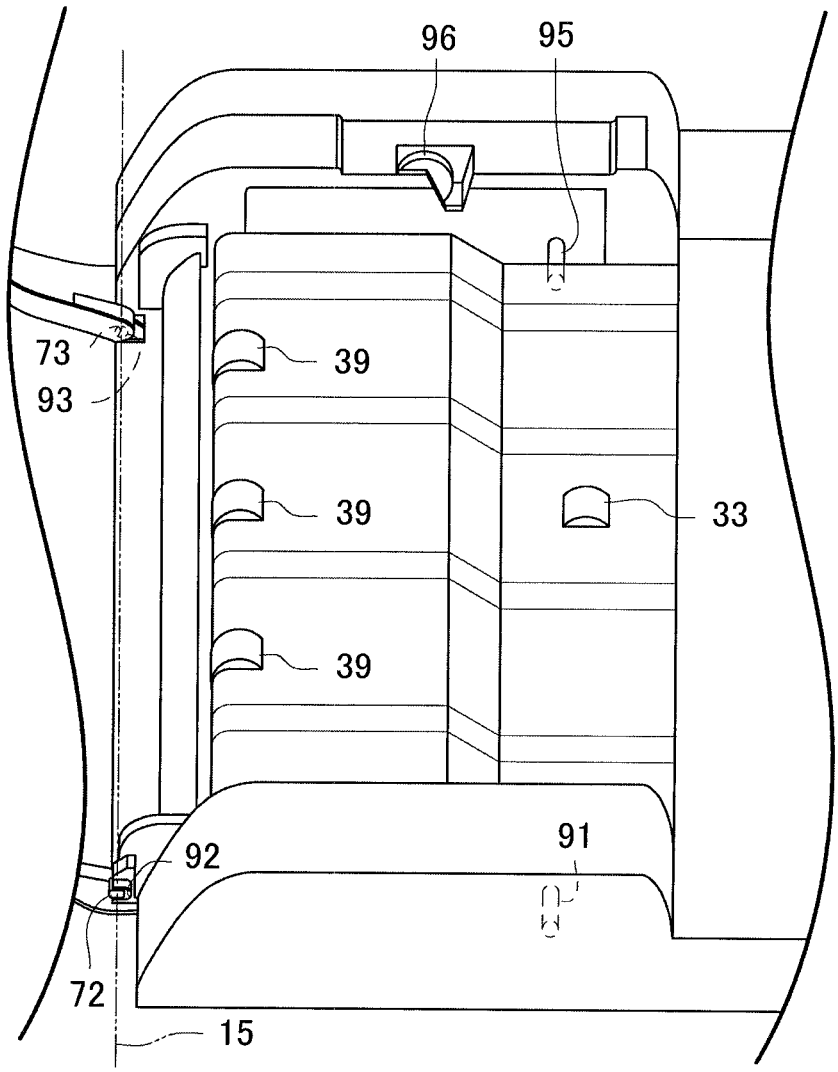
FIG. 5 is a schematic view describing a configuration of an upper surface of the ADF main body.

The configuration of the components arranged in the cover 11 will be described in detail below with reference to FIGS. 4 and 5. FIG. 4 is a perspective view illustrating the state of the cover 11 on the ADF main body 16 side. FIG. 5 is a schematic view describing a configuration of an upper surface of the ADF main body 16. In the following description, the side including the cover turning shaft 15 (approximately lower side in FIG. 4) is referred to as the "basal end side", and the opposite side (approximately upper side in FIG. 4) is referred to as the "distal end side" in the cover 11.

As illustrated in FIG. 4, a cover attachment hole 73 and a cover attachment shaft 72 are formed at the most basal end side of the cover 11. As illustrated in FIG. 5, a cover attachment shaft 93 that can be inserted to the cover attachment hole 73, and a cover attachment hole 92 for turnably attaching the cover attachment shaft 72 are formed in the ADF main body 16. The cover 11 can be opened and closed with respect to the ADF main body 16 with the line passing the center of the cover attachment shaft 72 and the center of the cover attachment shaft 93 as the cover turning shaft 15.

As illustrated in FIG. 4, the cover 11 is bent slightly on the basal end side relative to the central portion. Three press rollers 37 are arranged in a line at such a bent area. As illustrated in FIG. 2, the press roller 37 is arranged to face the resist roller 39 arranged in the ADF main body 16. The press roller 37 is supported by a press roller shaft 42, and the press roller shaft 42 is biased in a direction of facing the resist roller 39 by a bias spring 40. With such a configuration, the press roller 37 can be pressed against the resist roller 39.

A cover side gear 46 is arranged slightly on the distal end side relative to the central portion of the cover 11. The cover side gear 46 is configured to gear with a main body side gear 96, illustrated in FIG. 5, when the cover 11 is closed. The main body side gear 96 is rotatable when the power from a drive device (not illustrated) arranged in the ADF main body 16 is transmitted, where the cover side gear 46 also rotates when the main body side gear 96 rotates with the cover 11 closed.

The cover side gear 46 is connected in a relatively non-rotatable with the separation roller shaft 41, and thus the separation roller shaft 41 also rotates when the cover side gear 46 rotates. When the separation roller shaft 41 rotates, the separation roller 32 connected in a relatively non-rotatable manner to the separation roller shaft 41 also rotates. Since the separation roller 32 is coupled to the pickup roller 31 through an appropriate drive transmitting mechanism 43, the pickup roller 31 also rotates when the separation roller 32 rotates. The power from the drive device arranged in the ADF main body 16 is transmitted to the pickup roller 31 and the separation roller 32 in such a manner.

As illustrated in FIG. 2, the separation roller 32 is configured to contact the opposing roller 33 when the cover 11 is closed.

A lock mechanism 80 arranged to lock and unlock the cover 11 is arranged in the vicinity of the end on the distal end side of the cover 11. The vicinity of the end on the distal end side is the range that can be reached by the finger of the user from the end on the distal end side. The lock mechanism 80 includes a first lock lever (cover side lock portion) 81, a first lever shaft (rotation shaft) 82, an unlock portion 83, a second lever shaft (rotation shaft) 84, and a second lock lever (cover side lock portion) 85 as the main configuration. Since the lock mechanism 80 of the present preferred embodiment preferably has each of the constituent elements integrally molded or connected in a relatively non-rotatable manner, when one constituent element of the lock mechanism 80 is turned, other constituent elements also turn in the same direction.

The first lock lever 81 is provided to lock the cover 11, and is configured to be hooked to a first lock pin (main body side lock portion) 91 illustrated in FIG. 5 when the cover 11 is closed. The first lock lever 81 is connected to the first lever shaft 82.

The first lever shaft 82 preferably has a circular column shape, and preferably includes a radially projecting projection in the vicinity of the center in a width direction. A first coil spring 74 is attached to such a projection to pull the projection formed on the first lever shaft 82 towards the basal end side of the cover 11. Thus, when subjected to the force in a direction of an arrow in FIG. 4, the first lock lever 81 turns in the relevant direction. The unlock portion 83 is connected to the end of the first lever shaft 82.

The unlock portion 83 unlocks the lock when locked with the cover 11 closed. The unlock portion 83 includes a first connecting plate (connecting portion) 101, a release knob (operating portion) 102, a rib (guide portion) 113, and a second connecting plate (connecting portion) 104. In the present preferred embodiment, the unlock portion 83 preferably is integrally molded.

The first connecting plate 101 is configured to project towards the distal end side of the cover 11. The first connecting plate 101 is connected to the first lever shaft 82 at the end on the basal end side, and is connected to the release knob 102 at the end on the distal end side.

The release knob 102 is the portion of the unlock portion 83 that is operated by the user when unlocking the cover 11. As described above, when subjected to the force from the first coil spring 74 and the second coil spring 75, the first lock lever 81 and the second lock lever 85 turn in the direction of the arrow in FIG. 4. However, if the user turns the release knob 102 in a direction of on outlined arrow in FIG. 4, the first lock lever 81 and the second lock lever 85 can be turned in the direction opposite to the arrow in FIG. 4.

The release knob 102 is constructed so that a plurality of ribs 113 arranged in parallel to each other project downward. The distal end portion (lower end portion) of the rib 113 is arranged so that the projecting amount gradually increases towards the downstream side in the document transporting direction, and is configured to a slanted shape as illustrated in FIG. 2 in a side view. According to such a shape, the document is prevented from getting caught at the release knob 102 when being transported.

The second connecting plate 104 is configured as a member having the same shape as the first connecting plate 101. The second connecting plate 104 is connected to the second lever shaft 84 at the end on the basal end side, and is connected to the release knob 102 at the end on the distal end side.

The configuration and the arrangement of the second lever shaft 84, the second lock lever 85, and the second coil spring 75 are substantially similar to the first lever shaft 82, the first lock lever 81, and the first coil spring 74 described above, and thus the description thereof will be omitted.

Since the lock mechanism 80 is preferably configured as a crank, the space on the ADF main body 16 side of the cover 11 can be effectively utilized by effectively using the recessed portion formed by the unlock portion 83. In the present preferred embodiment, the pickup roller 31 is arranged so as to enter the recessed portion.

The mechanism of locking and unlocking the cover 11 will now be described with reference to FIGS. 6A to 6D. FIGS. 6A to 6D are schematic views describing a state in which the locking and the unlocking are carried out by the first lock lever 81 and the first lock pin 91. The first lock lever 81 and the first lock pin 91 will be described herein, but the description on the second lock lever 85 and the second lock pin (main body side lock portion) 95 will be omitted as similar operation is carried out.

Figure 6A:
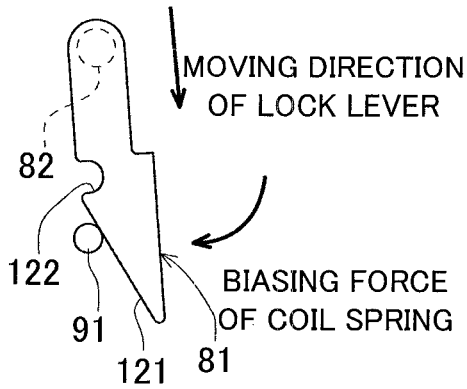
FIGS. 6A to 6D are schematic views describing a state in which locking and unlocking are carried out by a first lock lever and a first lock pin.
Figure 6B:
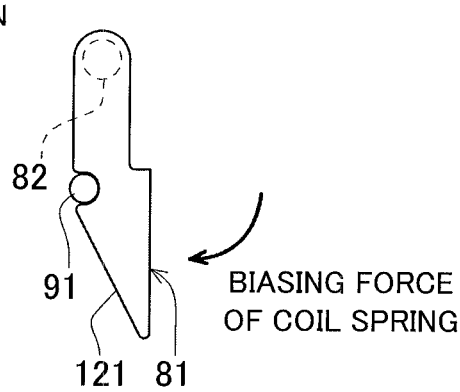
Figure 6C:
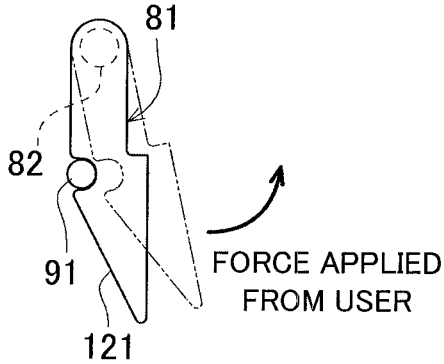

First, a case of locking the cover 11 will be described. The ADF 25 of the present preferred embodiment is configured such that lock is automatically carried out by simply closing the cover 11. Specifically, when the cover 11 is being closed, an inclined surface 121 provided at the first lock lever 81 is brought in contact with the first lock pin 91, and thereafter, the first lock pin 91 pushes the inclined surface 121 thereby turning the first lock lever 81, as illustrated in FIG. 6A. When the cover 11 is further closed, the first lock pin 91 enters a recessed portion 122 formed in the first lock lever 81, as illustrated in FIG. 6B.

When the first lock pin 91 is in the recessed portion 122, the cover 11 does not move regardless of in which opening/closing direction the force is applied to the cover 11 since the first lock pin 91 is fitted in the recessed portion 122. Furthermore, the first lock pin 91 does not come out of the recessed portion 122 since a biasing force by the first coil spring 74 is applied.

Figure 6D:
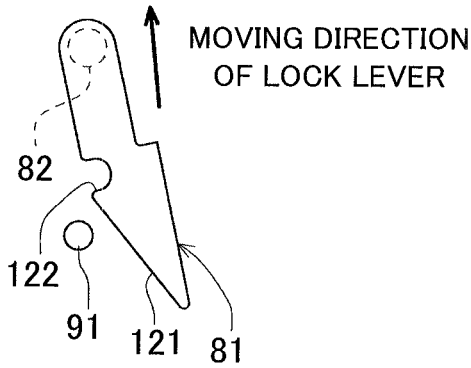

In order to unlock the lock from the locked state, the user merely needs to turn the release knob 102 in the direction opposite to the arrow of FIG. 4. When the release knob 102 is turned in the relevant direction, the first lock lever 81 is subjected to the force in a direction indicated in FIG. 6C thereby moving to the position indicated with a chain doubledashed line in FIG. 6C. The cover 11 can be opened, as illustrated in FIG. 6D, by applying force in the direction of opening the cover 11 in such a state.

The image scanner device 10 of the present preferred embodiment preferably has a configuration including a release plate (second unlock portion) 89 in addition to the unlock portion 83. The release plate 89 is fixed to the first lever shaft 82, so that the first lock lever 81 and the second lock lever 85 can be turned in the same direction by turning the release plate 89. Thus, the user can unlock the cover 11 and open the cover with not only the release knob 102, but also by operating the release plate 89.

The release plate 89 is arranged on the side closer than the release knob 102, and is configured to be exposed at the upper surface of the cover 11. Therefore, in a case in which it is difficult to stretch the hand to the release knob 102 from a front surface side of the device when the user is temporarily holding the document under the arm, and the like, the user can use the release plate 89 on the near side to open the cover 11, which enhances the workability.

As described above, the ADF 25 of the present preferred embodiment preferably includes the ADF main body 16, the first lock pin 91 and the second lock pin 95, the cover 11, the first lock lever 81 and the second lock lever 85, and the unlock portion 83. The first lock pin 91 and the second lock pin 95 are arranged in the ADF main body 16. The cover 11 is supported in an openable/closable manner at the ADF main body 16. The first lock lever 81 and the second lock lever 85 lock the cover 11 so as not to open by being hooked to the first lock pin 91 and the second lock pin 95, respectively, when the cover 11 is closed. The unlock portion 83 is arranged on the surface on the ADF main body 16 side of the cover 11 and in the vicinity of the end on the distal end side of the cover 11, and can unlock the lock of the first lock lever 81 and the second lock lever 85.

The surface on the outer side of the cover 11 is thus made flat since the unlock portion 83 is arranged on the inner side of the cover 11, and the document, etc. are prevented from being caught at the unlock portion 83.

The ADF 25 of the present preferred embodiment includes the first lever shaft 82 arranged to connect the unlock portion 83 and the first lock lever 81. The ADF 25 also includes the second lever shaft 84 arranged to connect the unlock portion 83 and the second lock lever 85. The unlock portion 83 includes the release knob 102, the first connecting plate 101, and the second connecting plate 104. The release knob 102 is arranged on the distal end side relative to the first lever shaft 82 and the second lever shaft 84, and is operated by the user. The first connecting plate 101 connects the release knob 102 and the first lever shaft 82, and the second connecting plate 104 connects the release knob 102 and the second lever shaft 84. The first lock lever 81 and the second lock lever 85 carryout the rotating operation by the operation force applied on the release knob 102, and can unlock the cover 11 by such a rotating operation.

The space on the basal end side relative to the release knob 102 then can be effectively used. The cover 11 is thus miniaturized, and a compact ADF 25 can be realized.

In the ADF 25 of the present preferred embodiment, the pickup roller 31 is arranged between the release knob 102 and the rotation shaft line of the first lever shaft 82, shown by the dotted and dashed line in FIG. 4, at the surface on the ADF main body 16 side of the cover 11.

The pickup roller 31 thus can be arranged on the distal end side of the cover 11, whereby the length from the end on the basal end side to the end on the distal end side of the cover 11 can be shortened.

In the ADF 25 of the present preferred embodiment, the direction of rotating the unlock portion 83 to unlock the lock is the same as the direction of opening the cover 11.

Thus, a direction of force applied by the user on the unlock portion 83 to unlock the lock and a direction of force applied by the user on the cover 11 to open the cover 11 may be the same. The user thus can open the cover 11 while unlocking the lock with one action.

In the ADF 25 of the present preferred embodiment, the unlock portion 83 is positioned at a center in a width direction of the document to be transported.

The cover 11 thus can be smoothly opened since force can be uniformly applied on the cover 11.

In the ADF 25 of the present preferred embodiment, the rib 113 arranged to guide the document to be transported is provided on the unlock portion 83.

The unlock portion 83 is thus prevented from inhibiting the transportation of the document. Furthermore, the number of components can be reduced by forming the rib 113 on the unlock portion 83, so that the cost can be reduced.

In the ADF 25 of the present preferred embodiment, the release plate 89 is arranged in addition to the unlock portion 83.

Therefore, the cover 11 can be unlocked from various positions.

The preferred embodiments of the present invention have been described above, but the above-described configuration can be modified as below.

In the above-described preferred embodiments, two sets of lock levers and lock pins are preferably provided, but one lock lever and lock pin may be arranged.

The above-described preferred embodiments preferably have a configuration including the release plate 89, but a configuration of unlocking the cover 11 with only the release knob 102 without including the release plate 89 may be adopted. In this case, a slim outer appearance of the upper surface of cover 11 can be realized.

In the above-described preferred embodiments, a configuration of locking by having the recessed portion 122 of the first lock lever 81 fitted to the first lock pin 91 preferably has been provided, but a configuration of hooking the hook-shaped member in place of the recessed portion may be adopted.

In place of the multifunction peripheral 20, the image scanner device 10 of the above-described preferred embodiments can also be applied to the copy machine, the facsimile device, and the like.

In the above-described preferred embodiments, the image scanner device 10 is preferably provided as one portion of the multifunction peripheral 20, but in place of such a configuration, the image scanner device 10 can be configured as an image scanner device of a single body.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A document scanning device comprising:

an automatic document transportation device including:

a main body;

a main body side lock portion arranged in the main body;

a cover supported in an openable and closable manner at the main body;

a cover side lock portion arranged to lock the cover so as not to open by being hooked to the main body side lock portion when the cover is closed;

an unlock portion arranged on an inner surface of the cover that faces the main body when the cover is closed and in the vicinity of an end on a distal end side which is a side distant from a cover turning shaft of the cover and arranged to unlock the cover side lock portion; and a rotation shaft arranged to connect the unlock portion and the cover side lock portion; wherein the unlock portion includes an operating portion arranged to be operated by a user to cause the unlock portion to unlock the cover side lock portion, the operating portion arranged to face the inner surface of the cover such that no portion of the operating portion directly faces any outer surface of the cover when the cover is closed;

the unlock portion includes a connecting portion arranged to connect the operating portion and the rotation shaft;

the cover side lock portion is arranged to perform a rotating operation in response to an operation force applied on the operating portion, and the lock of the cover is unlocked by the rotating operation;

a pickup roller associated with a paper feeding process of the document scanning device is arranged between the operating portion and a rotation shaft line of the rotation shaft on the inner surface of the cover;

a separation roller is arranged directly downstream from the pickup roller in a paper feeding direction of the paper feeding process;

an opposing member is arranged to face the separation roller when the cover is closed;

the pickup roller is arranged to supply documents from a document tray to a document transportation path;

the separation roller is arranged to rotate in a direction of the document transportation path;

when the pickup roller is driven and if one or more documents is in the document tray, at least one document from the one or more documents is transported from the document tray to the separation roller and is nipped by the separation roller and the opposing member; and if at least two documents from the one or more documents are transported from the document tray to the separation roller, the at least two documents are separated one-by-one by the separation roller and the opposing member.

2. The document scanning device according to claim 1, wherein a direction of rotating the unlock portion to unlock the lock is the same as a direction of opening the cover.

3. The document scanning device according to claim 2, wherein the unlock portion is positioned at a center in a width direction of a document to be transported.

4. The document scanning device according to claim 3, wherein the unlock portion includes a guide portion arranged to guide the document to be transported.

5. The document scanning device according to claim 4, further comprising a second unlock portion in addition to the unlock portion.

6. The document scanning device according to claim 1, wherein the operating portion is enclosed by the inner surface of the cover so as to face the inner surface of the cover.

* * * * *